US005803288A

United States Patent [19]

Munini

[11] Patent Number: 5,803,288

[45] Date of Patent: Sep. 8, 1998

[54] CAP FOR BOTTLES HAVING RESILIENTLY BIASED SEAL MEMBER

[75] Inventor: Dino Munini, S. Quirino, Italy

[73] Assignee: Microstamp Srl, Quirino, Italy

[21] Appl. No.: 626,331

[22] Filed: Apr. 2, 1996

[30] Foreign Application Priority Data

Apr. 6, 1995 [IT] Italy ..... UD95A0060

[51] Int. Cl.[6] ..... B65D 41/30

[52] U.S. Cl. ..... 215/342; 215/275

[58] Field of Search ..... 215/342, 341, 215/275, 274

[56] References Cited

U.S. PATENT DOCUMENTS

| | | | |
|---|---|---|---|
| 320,715 | 6/1885 | Spriegel | 215/342 X |
| 1,425,237 | 8/1922 | Carlson . | |
| 2,050,754 | 8/1936 | Herrmann | 215/342 |
| 3,457,958 | 7/1969 | Noren | 215/342 X |
| 3,716,161 | 2/1973 | Julian et al. | 215/342 X |
| 4,280,632 | 7/1981 | Yuhara | 215/342 X |

FOREIGN PATENT DOCUMENTS

| | | | |
|---|---|---|---|
| 247536 | 12/1987 | European Pat. Off. . | |
| 2476608 | 8/1981 | France . | |
| 2543557 | 4/1984 | France . | |
| 2547281 | 12/1984 | France . | |
| 2662427 | 11/1991 | France . | |
| 360756 | 10/1922 | Germany . | |
| 2726428 | 12/1978 | Germany | 215/342 |
| 430334 | 2/1948 | Italy | 215/342 |

*Primary Examiner*—Sue A. Weaver
*Attorney, Agent, or Firm*—Antonelli, Terry, Stout & Kraus, LLP

[57] ABSTRACT

Cap of a type suitable to be used for the momentary closure of bottles containing gaseous or aerated liquids, the cap comprising an outer sheath (13, 113) open at its lower end, within which is installed a longitudinally slidable supporting and closure element (14) including at its lower end a seal (15) which is rested on the mouth (12) of the bottle. The supporting and closure element (14) cooperates at its upper end with resilient thrust elements (16) firmly secured to the outer sheath (13, 113) and also comprising anchorage legs (18, 118) which can be deformed resiliently in a radial direction and which bear terminal claw elements (19, 119), the anchorage legs (18, 118) cooperating with a clamp having at least one first working position, in which the cap (10) is anchored to the bottle, and a second inactive position, in which the cap is free to be withdrawn from the bottle. The clamp has coordinated projections (22, 122) which can be arranged circumferentially against the anchorage legs (18, 118), the projections (22, 122) cooperating momentarily with the anchorage legs (18, 118) so as to clamp the same against the neck (11) of the bottle.

4 Claims, 1 Drawing Sheet

CAP FOR BOTTLES HAVING RESILIENTLY BIASED SEAL MEMBER

BACKGROUND OF THE INVENTION

This invention concerns a cap for bottles.

The cap for bottles according to the invention is used for the momentary closure of bottles containing gaseous liquids, which are advantageously effervescent wines such as sparkling wines or champagne, when the original mushroom-type corks of the bottles have been drawn.

The cap according to the invention enables such bottles of sparkling wine to be closed with a seal engagement, thus enabling the characteristics of the wines to be preserved even for relatively long times.

Bottles are known which contain sparkling wines and are closed with a mushroom-type stopper made of cork or plastic, the stopper having the task of preventing the emerging of the dissolved gas.

When the bottle has been opened, these wines tend to lose all their effervescence, thereby changing radically their organoleptic characteristics to such an extent that they become undrinkable.

The state of the art covers auxiliary caps to be applied to bottles containing gaseous liquids when those bottles have been opened.

These auxiliary caps consist of bowl-shaped means open at their lower side and containing a closure element generally consisting of a rubber disk, which is placed in contact with the mouth of the neck of the bottle and is pressed resiliently against that mouth.

These bowl means include external retaining means which cooperate resiliently with the ridge of the neck of the bottle.

These caps of the state of the art include anchorage means which are visible and which cooperate with the exterior of the bowl means.

DE-A-360.756 discloses a metal cap for a bottle with an outer slider that cooperates with resilient blades anchored to the upper part of the cap and including perpendicular slits.

When the outer slider is thrust towards the bottle, the blades approach the same and anchor themselves to the neck of the bottle; if the slider is rotated, it is anchored/removed to/from those slits, thus stabilising the clamping or eliminating the same.

This cap entails the obvious problem of safety for the user, the problem of a stable anchorage between the cap and the outer slider in the position of the open cap, the problem of a double operation of thrust and rotation to achieve the anchorage/removal, the problem of the depositing of dirt in the slits and in the inner part of the outer slider and also the problem of the unpractical nature of the whole means.

SUMMARY OF THE INVENTION

So as to improve the external appearance and to assist the operations of clamping and unclamping the cap on the bottle as compared to the caps of the state of the art, the present applicants have designed, tested and embodied the cap of this invention.

The purpose of this invention is to provide a cap for bottles which makes possible a hermetic seal of the bottle and which is practical to use.

The cap according to the invention includes anchorage elements arranged about the periphery of the neck of the bottle in a position where they are not visible.

The cap according to the invention includes an outer sheath, which is open at its lower end and acts also as a grip for the user.

This outer sheath cooperates internally with resilient means acting on a supporting and closure element, which is installed so as to be able to slide longitudinally within the outer sheath and includes in its lower portion sealing means, which cooperate with the mouth of the neck of the bottle.

This supporting and closure element has a lower inactive position, in which the resilient means are fully distended, and a raised working position, in which the element is thrust resiliently against the mouth of the bottle by the resilient means, which are at least partly compressed.

In a first form of embodiment the outer sheath includes at its lower end anchorage legs, which can be deformed radially in a resilient manner and which comprise at their lower end claw means facing radially inwards and able to cooperate with the lower edge of the ridge on the neck of the bottle.

These anchorage legs cooperate outwardly with a clamping ring, which is longitudinally stationary but can be rotated against the outer sheath so as to cover the exterior of the anchorage legs.

The clamping ring contains a plurality of internal and circumferential projections in a number coordinated with the anchorage legs and alternated with a mating plurality of spaces and has at least two different angular positions.

To be more exact, the clamping ring has a first working position, in which the projections cooperate with the anchorage legs and thrust those legs radially inwards to clamp the claw means against the ridge on the neck of the bottle, and a second inactive position, in which the anchorage legs are free to be deformed radially outwards, thus cooperating with the plurality of spaces and releasing the neck of the bottle.

The removal of the cap from the bottle is carried out by rotating the outer sheath by a desired and determined angle in relation to the clamping ring, or viceversa, so as to bring the clamping ring to its inactive position, and by then removing the cap.

In a second form of embodiment of the invention the outer sheath has the clamping ring fitted coaxially in an internal position. In this case the clamping ring is installed so as to be able to slide longitudinally within the outer sheath and has a first working position and a second inactive position.

The clamping ring includes actuation means, which are accessible from outside and which enable the clamping ring to be clamped momentarily in relation to the outer sheath during the operations of removal of the cap.

The outer sheath contains internally an expansion space in which the anchorage legs are free to be deformed resiliently outwards when the clamping ring is in its inactive position.

The outer sheath includes at its lower end a circumferential ridge cooperating with the lower terminal part of the anchorage legs when the clamping ring is in its working position.

The release of the cap is carried out by thrusting the outer sheath downwards and keeping the clamping ring in position by means of actuation means and by then removing the cap from the bottle.

BRIEF DESCRIPTION OF THE DRAWINGS

The attached figures are given as a non-restrictive example and show two preferred embodiments of the invention as follows.

DETAILED DESCRIPTION OF THE PREFERRED EMBODIMENTS

Figure 2A:
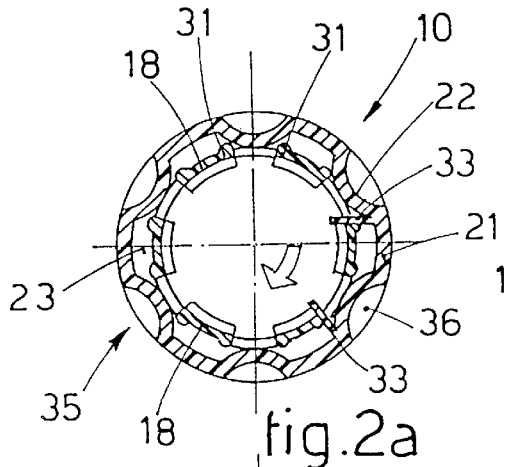
FIGS. 2*a* and 2*b* show a cross-section of the cap along the line A—A of FIG. 1 in the unclamping position and clamping position respectively.

The reference number 10 in the figures denotes generally a cap according to the invention.

The cap 10 according to the invention is applied advantageously, but not only, to bottles containing effervescent liquids, such as sparkling wines or champagne, so as to close those bottles momentarily.

The cap 10 according to the invention is applied to the neck 11 of the bottle so as to close the mouth 12 of the bottle momentarily with a seal engagement.

The cap 10 comprises an outer sheath 13 which is open at its lower end and within which a supporting and closure element 14 is fitted so as to be able to slide longitudinally.

The supporting and closure element 14 includes at its lower end sealing means 15 consisting advantageously of a rubber element which is rested on the mouth 12 of the bottle so as to close the bottle hermetically.

The supporting and closure element 14 cooperates at its upper end with resilient thrust means 16, which are firmly fixed at their upper end to the outer sheath 13 and at their lower end to the supporting closure element 14.

In this case, the resilient thrust means 16 consist of a helicoidal spring 32, which is secured by being inserted into suitable seatings 17 provided in the outer sheath 13 and in the upper part of the supporting closure element 14.

Figure 2B:
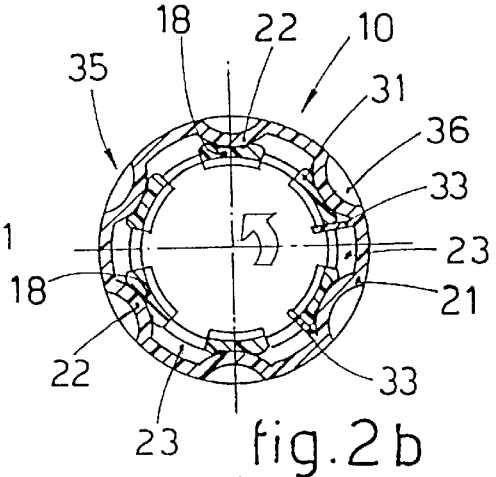
Figure 1:
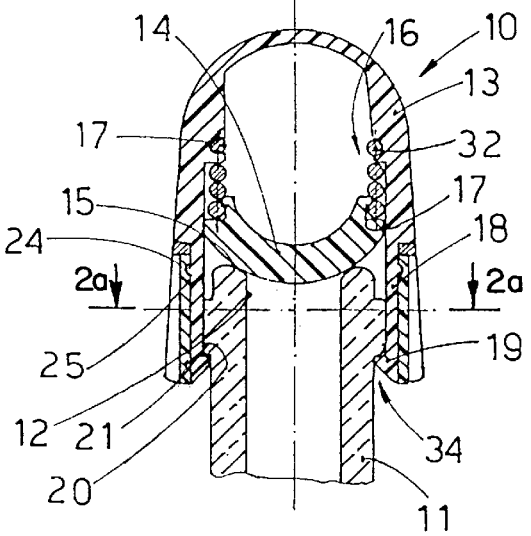
FIG. 1 shows a longitudinal section of a first form of embodiment of the cap according to the invention.
Figure 3:
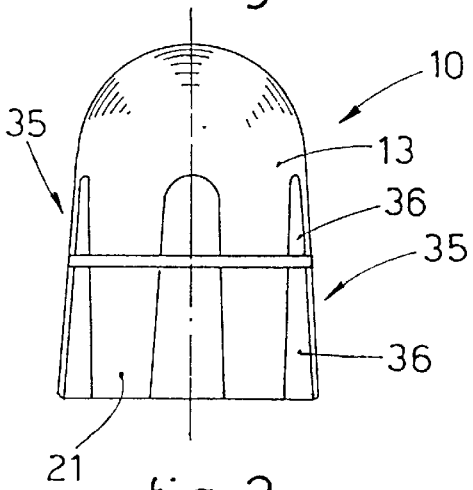
FIG. 3 is a front view of the cap of FIG. 1.

In the form of embodiment shown in FIGS. 1 to 3 the outer sheath 13 includes at its lower end anchorage legs 18, which can be deformed resiliently in a radial direction and include at their lower end claw elements 19 protruding radially inwards.

The claw elements 19 include advantageously on their lower surface a bevelled portion 34 which facilitates the operations of insertion onto the mouth 12 of the bottle.

The claw elements 19, when the cap has been inserted onto the mouth 12 of the neck 11 of the bottle, are anchored to the lower edge of the ridge 20 on the neck 11 so as to clamp the cap 10 to the bottle.

The anchorage legs 18 cooperate on their outer side with a clamping ring 21, which can be rotated but is stationary longitudinally and has at least two different angular positions, a first angular working position (FIG. 2*b*) and a second angular inactive position (FIG. 2*a*).

In this case, the longitudinal clamping of the clamping ring 21 on the outer sheath 13 is obtained by means of a circumferential ledge 24 included peripherally on the outer sheath 13 and cooperating with a mating slot 25 provided in the inner surface of the clamping ring 21 at a high position.

The clamping ring 21 contains on its inner surface a plurality of longitudinal projections 22 alternating with a mating plurality of expansion spaces 23, the plurality of longitudinal projections 22 being coordinated with the plurality of anchorage legs 18.

In this case the longitudinal projections 22 are shaped as an arc of a circle so as to assist the relative sliding of the clamping ring 21 on the anchorage legs 18 when the clamping ring 21 is rotated.

In this example the outer surface of the anchorage legs 18 includes lateral bulges 31, which keep the projections 22 in position when the clamping ring 21 has been brought to its angular working position.

In the angular working position of the clamping ring 21 the projections 22 cooperate with the respective anchorage legs 18 so as to prevent the outward resilient deformation of the legs 18 and therefore so as to anchor the cap 10 by means of the claw elements 19 against the ridge 20 on the neck 11 of the bottle.

In the angular inactive position of the clamping ring 21 the expansion spaces 23 are in a position so as to mate with the respective anchorage legs 18, thus making possible a resilient outward deformation of the legs 18 and the extraction of the cap 10 from the neck 11 of the bottle.

According to a variant the clamping ring 21 includes travel-limiting elements 33, which determine the two extreme angular positions, namely the working position and inactive position, of the clamping ring 21 and cooperate with at least one anchorage leg 18.

In this case, so as to facilitate the operation of relative rotation of the clamping ring 21 against the outer sheath 13, both the clamping ring 21 and the outer sheath 13 include anchorage and engagement elements 35 consisting of longitudinal grooves 36 provided on their outer surface.

Figure 4:
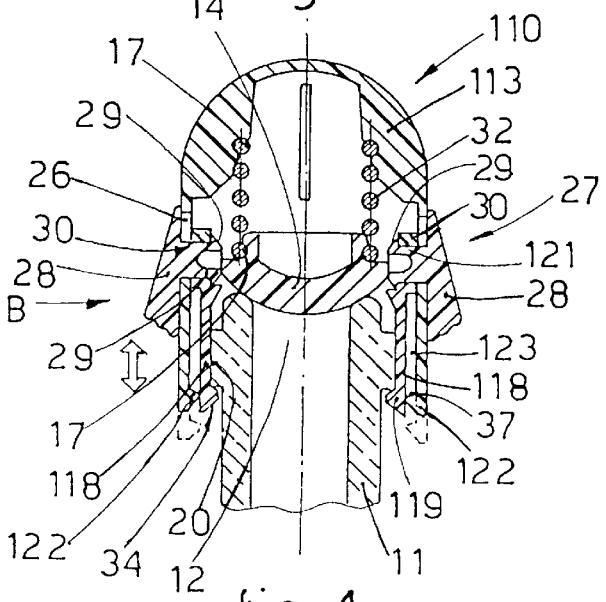
FIG. 4 is a longitudinal section of a second form of embodiment of the cap according to the invention.
Figure 5:
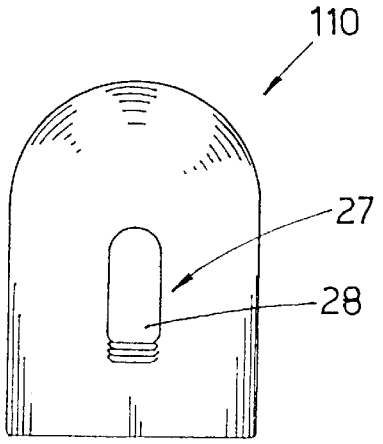
FIG. 5 is a side view of the cap according to the arrow B of FIG. 4.

In the form of embodiment shown in FIGS. 4 and 5 the cap 110 has the clamping ring 121 coaxial with, and able to slide longitudinally within, the outer sheath 113.

The outer sheath 113 contains two lateral longitudinal channels 26 for the positioning and movement of actuation means 27 associated with the clamping ring 121.

These actuation means 27 are positioned diametrically opposite to each other and consist in this case of two sliders 28, which are associated by means of anchorage teeth 29 with a seating 30 provided in a coordinated position on the clamping ring 121.

In this form of embodiment the clamping ring 121 includes in its lower part anchorage legs 118 comprising inwardly facing terminal claw elements 119.

The outer sheath 113 includes at its lower end a circumferential projection 122 cooperating at least momentarily with the anchorage legs 118 of the clamping ring 121.

This circumferential projection 122 defines at its upper end an expansion space 123 in which the anchorage legs 118 can be resiliently deformed outwards during the step of removal of the cap 110 from the neck 11 of the bottle.

The circumferential projection 122 includes at its upper end a bevelled portion 37 which facilitates the sliding of the projection 122 on the end of the anchorage legs 118.

In this case the removal of the cap 110 takes place by keeping the clamping ring 121 in position by means of the actuation means 27 and by thrusting the outer sheath 113 downwards, until the claw elements 119 are freed, and by then removing the cap 110.

This unclamping and removal operation can be carried out with only one hand.

I claim:

1. Cap of a type suitable to be used for the momentary closure of bottles containing gaseous liquids, the cap comprising an outer sheath open at its lower end, within which is installed a longitudinally slidable supporting and closure element including at its lower end a seal which is rested on the mouth of the bottle, the supporting and closure element cooperating at its upper end with a resilient thrust element firmly secured to the outer sheath and also comprising anchorage legs which can be deformed resiliently in a radial direction and which bear terminal claw elements, the anchorage legs cooperating with a clamping ring having at least one first working position, in which the cap is anchored to the bottle, and a second inactive position, in which the cap is free to be withdrawn from the bottle, the cap being characterised in that the anchorage legs are movably associated at least radially with the outer sheath and therewithin, coordinated projections being included and being arranged circumferentially to the anchorage legs and facing theretowards, the projections cooperating momentarily with the anchorage legs when the clamping ring is in the first working position so as to clamp the anchorage legs against the neck of the bottle, wherein the clamping ring can be rotated perpendicularly to a longitudinal axis of the cap, the coordinated projections being provided on an inner surface of the clamping ring and alternating with a plurality of spaces, the clamping ring being provided circumferentially to a lower part of the outer sheath.

2. Cap as in claim 1, in which the clamping ring includes on its outer side anchorage and engagement elements.

3. Cap of a type suitable to be used for the momentary closure of bottles containing gaseous liquids, the cap comprising an outer sheath open at its lower end, within which is installed a longitudinally slidable supporting and closure element including at its lower end a seal which is rested on the mouth of the bottle, the supporting and closure element cooperating at its upper end with a resilient thrust element firmly secured to the outer sheath and also comprising anchorage legs which can be deformed resiliently in a radial direction and which bear terminal claw elements, the anchorage legs cooperating with a clamping ring having at least one first working position, in which the cap is anchored to the bottle, and a second inactive position, in which the cap is free to be withdrawn from the bottle, the cap being characterised in that the anchorage legs are movably associated at least radially with the outer sheath and therewithin, coordinated projections being included and being arranged circumferentially to the anchorage legs and facing theretowards, the projections cooperating momentarily with the anchorage legs when the clamping ring is in the first working position so as to clamp the anchorage legs against the neck of the bottle, wherein the clamping ring is installed within, and coaxial with, and movable longitudinally to the outer sheath and is associated with outer slider means by means of longitudinal channels included in the outer sheath, the coordinated projections being provided at a lower portion of the outer sheath and having an upper space for the temporary lodgement of the anchorage legs.

4. Cap as in claim 3, wherein the first working position of the clamping ring is longitudinally higher than the second inactive position.

* * * * *